US008540396B2

(12) United States Patent
Watanabe et al.

(10) Patent No.: US 8,540,396 B2
(45) Date of Patent: Sep. 24, 2013

(54) LIGHTING SYSTEM

(75) Inventors: Satoshi Watanabe, Mishima (JP); Keiichi Shimizu, Yokohama (JP); Takeshi Osada, Zushi (JP); Keiichi Shimizu, Yokohama (JP); Toshiya Tanaka, Yokohama (JP); Shigeru Osawa, Yokohama (JP); Takeshi Hisayasu, Tokyo (JP); Hirokazu Otake, Yokosuka (JP); Hitoshi Kawano, Yokohama (JP); Makoto Sakai, Chigasaki (JP)

(73) Assignee: Toshiba Lighting & Technology Corporation, Yokosuka-shi, Kanagawa (JP)

( * ) Notice: Subject to any disclaimer, the term of this patent is extended or adjusted under 35 U.S.C. 154(b) by 0 days.

(21) Appl. No.: 13/597,992

(22) Filed: Aug. 29, 2012

(65) Prior Publication Data

US 2012/0320565 A1 Dec. 20, 2012

Related U.S. Application Data

(63) Continuation of application No. 13/119,519, filed as application No. PCT/JP2009/069423 on Nov. 16, 2009.

(30) Foreign Application Priority Data

| | | |
|---|---|---|
| Nov. 28, 2008 | (JP) | 2008305583 |
| Nov. 28, 2008 | (JP) | 2008305584 |
| Nov. 28, 2008 | (JP) | 2008305585 |
| Dec. 26, 2008 | (JP) | 2008333678 |
| Dec. 26, 2008 | (JP) | 2008333680 |

(51) Int. Cl.
*H01R 33/00* (2006.01)
*F21V 15/00* (2006.01)

(52) U.S. Cl.
USPC ..... 362/249.02; 362/655; 362/365

(58) Field of Classification Search
USPC ..... 362/294, 373, 249.02, 362, 364, 362/365, 655
See application file for complete search history.

(56) References Cited

U.S. PATENT DOCUMENTS

| | | | |
|---|---|---|---|
| 4,176,391 | A | 11/1979 | Kulik et al. |
| 4,591,961 | A | 5/1986 | Myles et al. |

(Continued)

FOREIGN PATENT DOCUMENTS

| | | | |
|---|---|---|---|
| CN | 101047102 | A | 10/2007 |
| JP | 07-034383 | | 2/1995 |

(Continued)

OTHER PUBLICATIONS

Notification of Reasons for Refusal for the corresponding Japanese Patent Application No. 2008-035585 dated Jul. 18, 2012.

(Continued)

*Primary Examiner* — Peggy A. Neils
(74) *Attorney, Agent, or Firm* — Banner & Witcoff, Ltd.

(57) ABSTRACT

A lighting fixture capable of efficiently radiating heat of a lamp device may be configured to be attached to a socket device. In some examples, by attaching the lamp device to the socket device, a cap portion of the lamp device is brought into contact with a fixture body, and pressed against and brought into close contact with the fixture body by an elastic body. Heat generated by lighting of LEDs of the lamp device is conducted from the cap portion to the fixture body and efficiently radiated.

8 Claims, 16 Drawing Sheets

(56) References Cited

U.S. PATENT DOCUMENTS

| | | | | |
|---|---|---|---|---|
| 5,264,997 | A * | 11/1993 | Hutchisson et al. | 362/645 |
| 5,327,332 | A | 7/1994 | Hafemeister | |
| 5,463,541 | A | 10/1995 | Greene | |
| 5,909,955 | A * | 6/1999 | Roorda | 362/368 |
| 6,036,336 | A | 3/2000 | Wu | |
| 6,120,167 | A | 9/2000 | Nace | |
| 6,578,994 | B1 | 6/2003 | Beyerlein | |
| 7,344,296 | B2 | 3/2008 | Matsui et al. | |
| 7,549,786 | B2 | 6/2009 | Higley et al. | |
| 7,654,688 | B2 * | 2/2010 | Li et al. | 362/240 |
| 7,766,512 | B2 | 8/2010 | Chou et al. | |
| 7,815,335 | B2 | 10/2010 | Frick | |
| 7,854,616 | B2 | 12/2010 | Janos et al. | |
| 7,866,838 | B2 | 1/2011 | Wang et al. | |
| 7,866,850 | B2 * | 1/2011 | Alexander et al. | 362/294 |
| 7,976,335 | B2 | 7/2011 | Weber et al. | |
| 8,152,334 | B2 | 4/2012 | Krogman | |
| 8,152,336 | B2 * | 4/2012 | Alexander et al. | 362/249.11 |
| 8,256,934 | B2 * | 9/2012 | Cunius | 362/373 |
| 2007/0103904 | A1 | 5/2007 | Chen | |
| 2007/0206369 | A1 | 9/2007 | Takeda et al. | |
| 2008/0186704 | A1 | 8/2008 | Chou et al. | |
| 2008/0232116 | A1 | 9/2008 | Kim | |
| 2008/0274641 | A1 | 11/2008 | Weber et al. | |

FOREIGN PATENT DOCUMENTS

| | | |
|---|---|---|
| JP | 2007-115594 | 5/2007 |
| JP | 2007-157367 | 6/2007 |
| JP | 2007-157368 | 6/2007 |
| JP | 2007-157603 | 6/2007 |
| JP | 2007-157690 | 6/2007 |
| JP | 2007-273205 | 10/2007 |
| JP | 2008-193189 A | 8/2008 |

OTHER PUBLICATIONS

Office Action received in corresponding Korean Patent Application 10-2011-7005381 dated Jun. 7, 2012.
International Search Report issued in PTC/JP2009-069423 on Feb. 16, 2010.
Office Action for corresponding U.S. Appl. No. 13/119,519 dated Oct. 9, 2012.
Notification of Reasons for Refusal issued in corresponding JP Patent Application No. 2008-305583 dated Sep. 12, 2012.
Notification of Reasons for Refusal issued in corresponding JP Patent Application No. 2008-305584 dated Sep. 12, 2012.
Notification of Reasons for Refusal issued in corresponding JP Patent Application No. 2008-333678 dated Sep. 12, 2012.
Office Action issued in corresponding Russian Patent Application No. 2011126378 dated Aug. 8, 2012.
Office Action received in corresponding Chinese Application No. 200980135603.X dated Sep. 26, 2012.
Notice of Allowance issued in corresponding U.S. Appl. No. 13/233,827 mailed Dec. 17, 2012.
Non Final Office Action issued in corresponding U.S. Appl. No. 13/597,804 mailed Oct. 24, 2012.
Non Final Office Action issued in corresponding U.S. Appl. No. 13/597,893 mailed Nov. 19, 2012.
Notice of Allowance issued in corresponding U.S. Appl. No. 13/597,953 mailed Nov. 9, 2012.
Decision of Refusal for corresponding JP Patent Application No. 2008-305585 dated Dec. 19, 2012.
Non-final Office Action received in U.S. Appl. No. 13/119,519 mailed Feb. 21, 2013.
Notice of Allowance issued in corresponding U.S. Appl. No. 13/597,893, mailed May 9, 2013.
Notification of Reasons for Refusal for corresponding JP Patent Application No. 2008-305585 dated Jul. 18, 2012.
Notification of Reasons for Refusal issued in corresponding Japanese Patent Application 2008-333680 mailed Dec. 19, 2012.
Notification of Reasons for Refusal received in corresponding Japanese Patent Application No. 2008-305583, mailed May 15, 2013.
Notification of Reasons for Refusal received in corresponding Japanese Patent Application No. 2008-305584, mailed May 15, 2013.
Notification of Reasons for Refusal received in corresponding Japanese Patent Application No. 2008-333678, mailed May 15, 2013.
Notice of Allowance issued in corresponding U.S. Appl. No. 13/597,804, mailed May 30, 2013.

* cited by examiner

LIGHTING SYSTEM

CROSS REFERENCE TO RELATED APPLICATIONS

The present application is a continuation of and claims priority to U.S. patent application Ser. No. 13/119,519 filed May 31, 2011 entitled "Lighting Fixture" and also claims priority to PCT Application No. PCT/JP2009/069423 filed on Nov. 16, 2009 which claims priority to Japanese Patent Application No. 2008-305583 filed Nov. 28, 2008, Japanese Patent Application No. 2008-305584 filed Nov. 28, 2008, Japanese Patent Application No. 2008-305585 filed Nov. 28, 2008, Japanese Patent Application No. 2008-333678 filed Dec. 26, 2008 and Japanese Patent Application No. 2008-333680 filed Dec. 26, 2008. The contents of these applications are incorporated herein by reference in their entirety.

TECHNICAL FIELD

Aspects relate to a lighting fixture using a flat lamp device having a cap portion at its one face side and a light source at the other face side.

BACKGROUND

Conventionally, a lamp device has been used which uses a GX53-type cap portion standardized by the IEC (International Electrotechnical Commission). The lamp device has a flat lamp device body, the GX53-type cap portion is provided on an upper face side of the lamp device body, a flat light source using a fluorescent lamp, LED or the like is arranged on a lower face side of the lamp device body, and a lighting circuit for lighting the light source is housed inside the lamp device body. On the cap portion, a pair of lamp pins each having a large diameter portion at its top end is projected. The lamp pins of the lamp device are inserted and hooked into a socket device by turning the lamp device, the lamp device is held by the socket device, and power is supplied from the socket device to the lamp pins.

DESCRIPTION OF EMBODIMENTS

Figure 1:
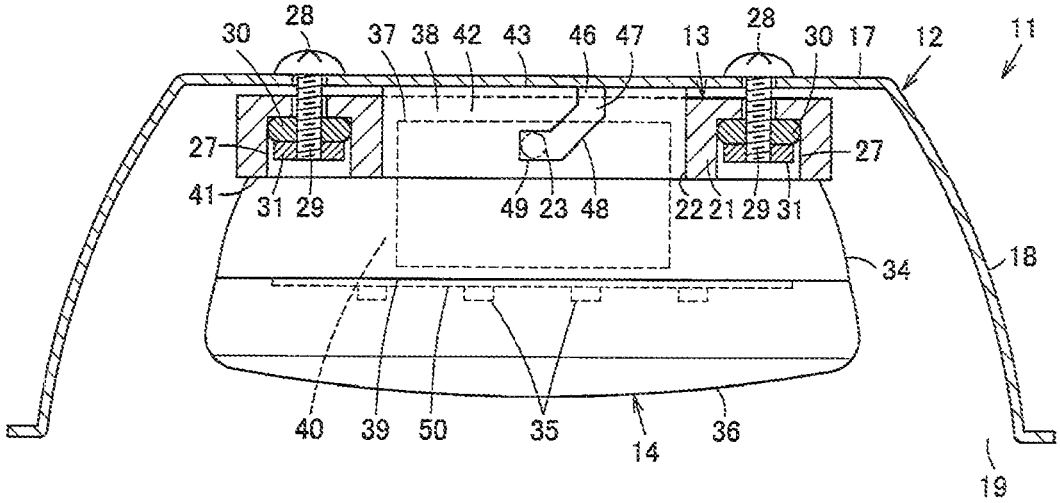
FIG. 1 is a cross sectional view of a lighting fixture, in which a lamp device is attached to a socket device, according to a first embodiment of the present invention.

When a lamp device is lit, a light source generates heat and heat radiation is necessary. If the heat is also radiated from a cap portion of the lamp device, effective heat radiation performance is obtained.

However, in a state that the cap portion of the lamp device is attached to a socket device, the area of the cap portion exposed to the outside becomes small and heat radiation performance is lowered in terms of the attachment structure. Although it is considered that heat is conducted from the cap portion to the socket device side, because a gap is generated between the cap portion and the socket device, and the cap portion and the socket device are not brought into close contact with each other, heat is not efficiently conducted from the cap portion to the socket device side and sufficient heat radiation performance is not obtained.

A lighting fixture according to some aspects may include a socket device which holds a cap portion provided at one face side of a flat lamp device and supplies power for lighting a light source arranged at the other face side of the lamp device to the cap portion; a heat radiating body which comes into contact with at least a part of the cap portion of the lamp device held by the socket device; and a pressing body for pressing the cap portion of the lamp device held by the socket device and the heat radiating body in a contact direction.

For example, a GX53-type cap structure is used for the cap portion of the lamp device, and a metallic material excellent in thermal conductivity may be used at least at a position where the cap portion comes into contact with the heat radiating body. In addition, a semiconductor light-emitting element such as an LED or an organic EL, a flat discharge lamp, or the like is usable for the light source as long as a flat thin light source is formed. A globe for covering the light source may be attached to the lamp device.

For example, a GX53-type cap portion of the lamp device can be attached to the socket device, and the socket device holds the cap portion and can supply power to the cap portion.

The heat radiating body is made of, for example, metal excellent in thermal conductivity and heat radiation performance, and may include a heat radiation structure such as fins and may also serve as a metallic reflection body, a fixture body or the like.

The pressing body uses, for example, an elastic body such as a spring or rubber, and may press the heat radiating body against the cap portion or press the cap portion against the heat radiating body.

The heat radiating body and the pressing body may be separately provided, or a heat radiating body with a pressing function may be singly provided. For example, an integral structure may be employed such as a metallic bellows having a heat radiating function and a pressing function.

According to other aspects, a fixture body may be provided on which the socket device is arranged, and the heat radiating body comes into contact with the cap portion of the lamp device and the fixture body.

The fixture body and the heat radiating body may be attached in advance so as to come into close contact with each other, or may be pressed against and brought into contact with each other in a contact direction by the pressing body for pressing the cap portion and the heat radiating body in the contact direction.

According to yet other aspects, a socket device may include an insertion hole into which a projection portion projected from the center of the cap portion of the lamp device is inserted, and the heat radiating body comes into face-contact with an end face of the projection portion inserted into the socket device.

The projection portion of the cap portion may be brought into contact with the heat radiating body by being projected from the socket device, or may be brought into contact with the heat radiating body in a state that the projection portion is not projected from the socket device and the heat radiating body is made to enter the socket device side.

Still further, a socket device may include a socket support body and a socket device body to/from which the cap portion of the lamp device can be attached/detached and which is movably supported by the socket support body between a housing position where the socket device body is housed in the socket support body side and a projecting position where the socket device body projects from the socket support body side.

The socket support body is, for example, attached to the fixture body or the like of the lighting fixture, and may support the socket device body with any constitution as long as the socket device body is movable between the housing position and the projecting position. A locking structure may also be used which locks the socket device body at the housing position. For the locking structure, a mechanism, for example, a button switch or a knock mechanism of a pen (pencil), can be used which switches a holding position from/to the projecting position to/from the housing position by repeating pressing operations. That is, the socket device body is locked in a manner of being pressed and moved from the projecting position to the housing position by the lamp device, and the lock is cancelled in a manner of slightly pressing the socket device body with the lamp device again so that the socket device body is allowed to move from the housing position to the projecting position. An energizing member such as a spring may be used in a projecting direction of the socket device body.

The GX53-type cap portion of the lamp device can be attached to the socket device body, and the socket device body holds the cap portion and can supply power to the cap portion.

According to still other aspects, a lamp device may include: a flat lamp device body; a cap portion provided on one face side of the lamp device body; a light source arranged on the other face side of the lamp device body; and a lighting circuit for lighting the light source.

The lamp device body and the cap portion may be integrally or separately provided.

The lighting circuit may be housed in the lamp device body or arranged together with the light source on the other face side of the lamp device body.

Moreover, a globe for covering the light source may be attached to the other face side of the lamp device body.

According to some aspects, a lamp device may include: a substrate attachment portion provided on the other face side of the lamp device body; a thermal conduction connection unit for thermally conductively connecting the substrate attachment portion and the cap portion to each other; and a light-emitting module substrate on which semiconductor light-emitting elements as the light source are mounted and which is attached to the substrate attachment portion.

The cap portion and substrate attachment portion of the lamp device body may be integrally or separately provided. When the cap portion and the substrate attachment portion are separately provided, these are brought into close contact with each other by the thermal conduction connection unit using a screw-clamping method or screw-engaging method, and the substrate attachment portion side is thermally conductively connected to the cap portion side. When the cap portion and the substrate attachment portion are integrally formed as the thermal conduction connection unit, the substrate attachment portion is thermally conductively connected to the cap portion.

In the light-emitting module substrate, for example, a wiring pattern is formed on a metallic substrate via an insulating layer, the semiconductor light-emitting elements are connected onto the wiring pattern. Then, the light-emitting module substrate is closely attached to the substrate attachment portion of the lamp device body with screws, or the like.

According to other aspects, a lamp device may include: a substrate attachment portion provided on the other face side of the lamp device body; a projection portion which is formed integrally with the substrate attachment portion and projected from the center of one face side of the substrate attachment portion to the cap portion side; and a light-emitting module substrate on which semiconductor light-emitting elements as the light source are mounted and which is attached to the substrate attachment portion.

The inside of the projection portion may be hollow or solid as long as the projection portion is formed integrally with the substrate attachment portion.

In the light-emitting module substrate, for example, a wiring pattern is formed on a metallic substrate via an insulating layer, the semiconductor light-emitting elements are mounted onto the wiring pattern. The light-emitting module substrate is closely attached to the substrate attachment portion of the lamp device body with screws, or the like.

According to some aspects, a socket device includes: a socket device body for holding the cap portion of the lamp device; a power supplying portion for supplying power to the lamp device held by the socket device body; and a signal transmitting portion for transmitting a signal to the lamp device held by the socket device body, and the lamp device includes: lamp pins which are connectable to the power supplying portion so as to receive power from the power supplying portion of the socket device; signal terminals which are connected to the signal transmitting portion so as to receive a signal transmitted from the signal transmitting portion of the socket device with the lamp pins connected to the power supplying portion; a lighting circuit which receives power from the lamp pins to light the light source; and a control circuit which receives a signal input in the signal terminals to adjust output of the lighting circuit.

The socket device body is formed of, for example, insulative synthetic resin, and the power supplying portion and the signal transmitting portion are arranged in the socket device body.

The power supplying portion is brought into contact with, and electrically connected to the lamp pins of the lamp device held by the socket device body.

The signal transmitting portion is brought into contact with, and electrically connected to the signal terminals of the lamp device held by the socket device body. As long as the signal transmitting portion is brought into contact with, and electrically connectable to the signal terminals in accordance with the shapes of the signal terminals, it may be, for example, arranged inside a hole formed in a surface of the socket device body, provided on the surface of the socket device body or projected from the socket device body.

The lamp pin, for example, projects from the cap portion, has a large diameter portion at its top end, is hooked to and held by the socket device by being attached to the socket device, and is electrically connected to the power supplying portion of the socket device so as to receive power.

The signal terminal may be, for example, projected from the cap portion, provided on a surface of the cap portion or arranged inside a hole formed in the surface of the cap portion as long as it is brought into contact with and electrically connected to the signal transmitting portion of the socket device with the lamp device held by the socket device. Any signal such as a modulation signal or an RGB signal is adoptable as long as the signal controls output of the light source.

Any circuit constitution is applicable to the lighting circuit if it enables output of the lighting circuit to be adjusted.

Any constitution is applicable to the control circuit if it enables output of the lighting circuit to be adjusted in accordance with an input signal.

According to various aspects, when the cap portion of a lamp device attached to a socket device and the heat radiating body are brought into contact with each other and pressed by a pressing body in a contact direction, a cap portion and a heat radiating body can be reliably brought into close contact with each other, heat can be efficiently conducted from the cap portion to the heat radiating body, and heat of a lamp device can be efficiently radiated from the cap portion.

Additionally or alternatively, when the heat radiating body comes into contact with the cap portion of the lamp device and a fixture body, heat can be efficiently conducted from the cap portion to the fixture body and heat of the lamp device can be efficiently radiated from the cap portion.

Still further, if an end face of the projection portion, which is inserted into the socket device, of the cap portion and the heat radiating portion comes into face-contact with each other, heat can be efficiently conducted from a projection portion of the cap portion to the heat radiating body.

In other examples, if the socket device body is made movable between a housing position where it is housed in a socket support body side and the projecting position where it projects from the socket support side, the lamp device can be easily attached/detached by moving a socket device body to a projecting position even if the socket device is used for a small lighting fixture. In addition, the cap portion of the lamp device and the heat radiating body can be brought into contact with each other by moving the socket device body to the housing position.

Moreover, heat of the lamp device can be efficiently radiated from a cap portion by attaching the lamp device to the socket device.

According to other aspects, when a light-emitting module substrate is attached to the substrate attachment portion of a lamp device body, and the substrate attachment portion is thermally conductively connected to the cap portion side from the substrate attachment portion side by a thermal conduction connection unit, heat generated by semiconductor light-emitting elements can be efficiently conducted to the cap portion side via a substrate attachment portion and heat radiation performance can be improved.

In various examples, if the substrate attachment portion and the projection portion are integrally formed with each other in the lamp device body and a light-emitting module substrate is attached to the other face side of the substrate attachment portion, heat generated by the semiconductor light-emitting elements can be efficiently conducted to a projection portion, which projects from the center of one face side of the substrate attachment portion, via the substrate attachment portion of the lamp device body, heat concentrated at the projection portion can be efficiently radiated from the projection portion, and heat radiation performance can be improved.

In still other examples, when power is supplied from a power supplying portion of the socket device to lamp pins of the lamp device and a signal can be transmitted from a signal transmitting portion of the socket device to signal terminals of the lamp device with the power supplying portion and the lamp pins connected to each other, the lamp device, by attaching the lamp device to the socket device, can receive a signal from the socket device and can adjust output of the lighting circuit in accordance with the signal.

Hereinafter, embodiments will be described with reference to the drawings.

Figure 2:
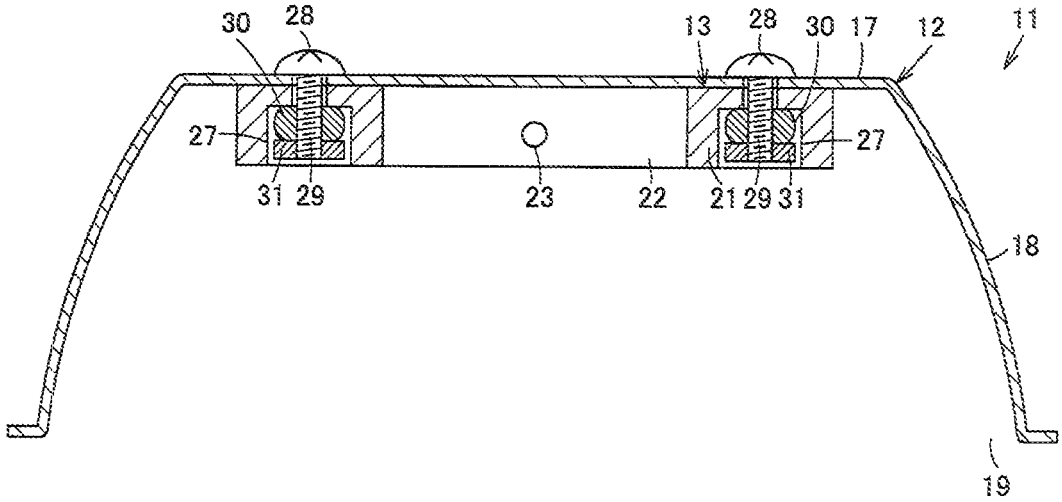
FIG. 2 is a cross sectional view of the lighting fixture in which the lamp device is detached from the socket device.
Figure 3:
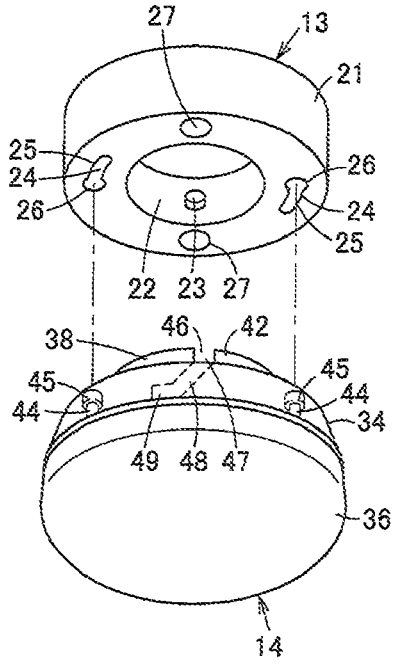
FIG. 3 is a perspective view of the socket device and the lamp device which are detached from each other.
Figure 4:
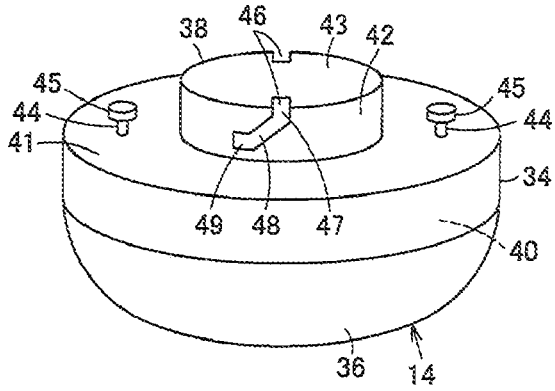
FIG. 4 is a perspective view of the lamp device.

FIGS. 1 to 4 show a first embodiment, FIG. 1 is a cross sectional view of a lighting fixture in which a lamp device is attached to a socket device, FIG. 2 is a cross sectional view of the lighting fixture in which the lamp device is detached from the socket device, FIG. 3 is a perspective view of the socket device and the lamp device which are detached from each other, and FIG. 4 is a perspective view of the lamp device.

A lighting fixture 11 is, for example, a downlight, and includes: a fixture body 12 as a heat radiating body; a socket device 13 attached to the fixture body 12; and a flat lamp device 14 attachable to/detachable from the socket device 13. Moreover, regarding a directional (vertical) relationship of these body and devices, description will be made below by setting a state, where the flat lamp device 14 is horizontally attached, as a reference and defining a cap portion side, which is one face side of the lamp device 14, as an upper face side and a light source side, which is the other face side of the lamp device 14, as a lower face side.

The fixture body 12 is made of metal, formed so as to serve as a reflection body as well, and has a circular flat plate portion 17 and a reflecting plate portion 18 curvedly bent downward from a circumferential portion of the flat plate portion 17. An opening portion 19 is formed on a lower face of the reflecting plate portion 18.

The socket device 13 has a cylindrical insulative socket device body 21 made of synthetic resin, and an insertion hole 22 is formed so as to vertically penetrate the center of the socket device body 21. A pair of projection portions 23 is projected on an inner face of the insertion hole 22 so as to extend to the center of the insertion hole 22.

A pair of socket portions 24 are formed at a lower face of the socket device body 21. A connection hole 25 is formed in each socket portion 24, and a bracket (not shown) for supplying power is arranged inside the connection holes 25. The connection holes 25 are arc-shaped grooves located rotationally symmetric with respect to the center of the socket device body 21, and an enlarged diameter portion 26 is formed at one end of each arc-shaped groove.

A plurality of recess portions 27 are formed on the lower face of the socket device body 21, a screw shaft 29 of a screw 28 is inserted and arranged in each recess portion 27 from the fixture body 12, and a nut 31 is screw-engaged with the screw shaft 29 via an elastic body 30 as a pressing body made of, for example, rubber. The socket device 13 is attached to the flat plate portion 17 of the fixture body 12 with these screws 28, elastic bodies 30 and nuts 31.

The lamp device 14 includes: a flat lamp device body 34; a plurality of LEDs 35 which are semiconductor light-emitting elements as a light source arranged on a lower face side of the lamp device body 34; a globe 36 for covering the LEDs 35; and a lighting circuit 37 for lighting the LEDs 35, and is thinly formed so that the size of its height direction is smaller than the size of its horizontal direction.

The lamp device body 34 is formed of, for example, insulative synthetic resin or metal such as aluminum excellent in heat radiation performance. A GX53-type cap portion 38 is formed on an upper face side which is one face side of the lamp device body 34, a flat substrate attachment portion 39, to which the LEDs 35 are attached, is formed on the lower face side which is the other face side thereof, and a housing portion 40 for housing the lighting circuit 37 is formed in the lamp device body 34.

In the cap portion 38, an annular contact face 41 coming into contact with a lower face of the socket device 13 is formed, and a columnar projection portion 42, which can be inserted into the insertion hole 22 of the socket device 13, is projected from the center of the contact face 41. The projection size of the projection portion 42 is larger than the height of the socket device 13, that is, the depth of the insertion hole 22, and an end face 43 of the projection portion 42 penetrates the insertion hole 22 and projects when the lamp device 14 is attached to the socket device 13.

A pair of metallic lamp pins 44 each having conductivity is projected on the contact face 41. A large diameter portion 45 is formed at a top end of the lamp pin 44. The large diameter portion 45 of each lamp pin 44 is inserted into the enlarged diameter portion 26 of each connection hole 25 of the socket device 13, the lamp pin 44 is moved from the enlarged diameter portion 26 to the connection hole 25 by turning the lamp device 14 and electrically connected to a bracket, the large diameter portion 45 is hooked to the bracket or an edge portion of the connection hole 25, the lamp device 14 is held by the socket device 13. Moreover, when the lamp device body 34 is made of metal, each lamp pin 44 is attached to the lamp device body 34 via an insulating member.

A pair of guide grooves 46, with which the projection portions 23 of the socket device 13 are engaged, is formed on a peripheral face of the projection portion 42. The guide groove 46 has an introduction groove portion 47 opened to the end face 43 of the projection portion 42, an inclined groove portion 48 inclined from the introduction groove portion 47 and a holding groove portion 49 horizontally extending from the inclined groove portion 48. The introduction groove portions 47 of the guide grooves 46 are aligned with the projection portions 23 of the socket device 13, the lamp device 14 is raised and turned in an attachment direction, the projection portions 23 and the inclined groove portions 48 are engaged with each other, the lamp device 14 is moved relatively upward, the socket device 13 is moved relatively downward, and engagement positions of the projection portions 23 with the holding groove portions 49 become, as a whole, an attachment position of the lamp device 14 to the socket device 13.

The plurality of LEDs 35 are mounted on a lower face side of a light-emitting module substrate 50. An upper face of the light-emitting module substrate 50 is brought into close face-contact with and attached to the substrate attachment portion 39 on the lamp device body 34. The light-emitting module substrate 50 is formed in a manner of, for example, forming a wiring pattern on a metallic substrate via an insulating layer and mounting the LEDs 35 on the wiring pattern, and attached to the substrate attachment portion 39 on the lamp device body 21 so as to come into close contact therewith screws, or the like. A light-emitting module is constituted by the plurality of LEDs 35 and the light-emitting module substrate 50.

The globe 36 is formed of glass or synthetic resin having transparency or light-diffuseness.

The lighting circuit 37 includes a lighting circuit substrate (not shown) and lighting circuit components (not shown) mounted on the lighting circuit, each lamp pin 44 is electrically connected to an input portion of the lighting circuit substrate via a lead wire or the like, and the light-emitting module substrate 50 is electrically connected to output portions of the lighting circuit substrate via lead wires or the like. When the lamp device body 34 is made of metal, the lighting circuit substrate and lighting circuit components are housed in the housing portion 40 of the lamp device body 34 via an insulating material.

Next, action of the lighting fixture 11 of the first embodiment will be described.

As shown in FIG. 2, the socket device 13, to which the lamp device 14 is not yet attached, is pushed upward by pressing of the elastic body 30, and an upper face of the socket device 13 is brought into contact with the flat plate portion 17 of the fixture body 12.

In order to attach the lamp device 14 to the socket device 13, the projection portion 42 of the lamp device 14 is inserted into the insertion hole 22 of the socket device 13 from below, the introduction groove portions 47 of the guide grooves 46 provided on the projection portion 42 of the lamp device 14 are aligned with the projection portions 23 of the socket device 13, the lamp pins 44 of the lamp device 14 are aligned with the enlarged diameter portions 26 of the connection holes 25 of the socket device 13, and the lamp device 14 is pushed upward and turned in the attachment direction. By pushing upward and turning the lamp device 14 in the attachment direction, the projection portions 23 and the inclined groove portions 48 of the guide grooves 46 are engaged with each other, the lamp device 14 is moved upward, and the end face 43 of the projection portion 23 comes into contact with the flat plate portion 17 of the fixture body 12. Further, by turning the lamp device 14 in the attachment direction, the socket device 13 moves downward against the pressing of the elastic body 30 in relation to the lamp device 14 which is restricted from moving upward by contact with the flat plate portion 17 of the fixture body 12. As shown in FIG. 1, by engagement of the projection portions 23 and the holding groove portions 49 of the guide grooves 46, the lamp device 14 is attached to the socket device 13 at the attachment position, and the lamp pins 44 are electrically brought into contact with the brackets of the socket device 13.

Since the socket device 13 is pushed upward by the pressing of the elastic body 30 with the lamp device 14 attached to the socket device 13, the end face 43 of the projection portion 42 from the upper face of the socket device 13 is pressed against and brought into close face-contact with the flat plate portion 17 of the fixture body 12.

Therefore, when the LEDs 35 of the lamp device 14 are lit, heat generated by the LEDs 35 is conducted from the light-emitting module substrate 50 to the cap portion 38, efficiently conducted from the end face 43 of the projection portion 42 to the fixture body 12 and efficiently radiated into air or the like.

Accordingly, even in the state that the lamp device 14 is attached to the socket device 13 of the fixture body 12, heat of the lamp device 14 can be sufficiently radiated from the cap portion 38. Therefore, the lamp device 14 obtains sufficient heat radiation performance, can restrict the temperature of the LED 35 from rising, and can prevent the LED from being thermally deteriorated and having a short life and, in some cases, light-emitting efficiency from being lowered.

Moreover, at least either the flat plate portion 17 of the fixture body 12 or the end face 43 of the lamp device 14 may be subjected, for improvement in thermal conductivity from the cap portion 38 to the fixture body 12, to surface treatment such as polishing for raising smoothness, or a thermally conductive member such as a gel material or heat radiation sheet having flexibility or elasticity and excellent in thermal conductivity may be arranged on at least either the flat plate portion 17 or the end face 43.

In addition, for other embodiments described below, the same symbols are attached to the same structures as those of the first embodiment, and description thereof will be omitted.

Figure 5:
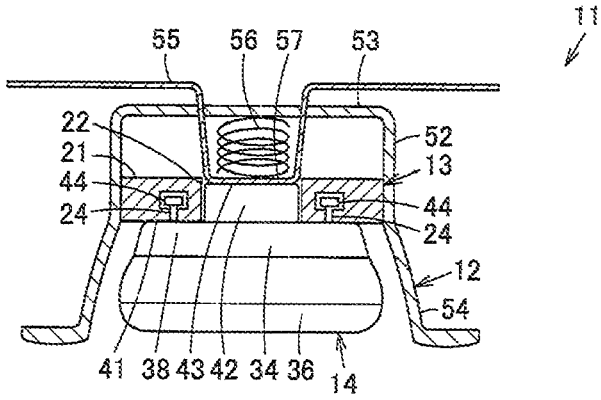
FIG. 5 is a cross sectional view of a lighting fixture according to a second embodiment of the present invention.

Next, FIG. 5 is a cross sectional view of a lighting fixture according to a second embodiment.

The fixture body 12 includes: a cylindrical portion 52; a top plate portion 53 provided on an upper face of the cylindrical portion 52; and a reflecting plate portion 54 projecting obliquely outward from a lower portion of the cylindrical portion 52.

The socket device 13 is fixed to a lower portion side of the cylindrical portion 52 of the fixture body 12, and a heat radiating plate 55 as a heat radiating body and a spring 56 as a pressing body are arranged in a space between the upper face of the socket device 13 and the top plate portion 53 of the fixture body 12.

The heat radiating plate 55 is made of metal, and includes: a contact portion 57, which is brought into face-contact with the end face 43 of the projection portion 42 projecting from the cap portion 38 of the lamp device 14 and has an approximately overturned U-shaped cross section, at its center portion; and both ends led outward from the fixture body 12, and is arranged vertically movably in relation to the fixture body 12. Fins or the like may be provided at both ends of the heat radiating plate 55 so as to raise the heat radiation effect.

The spring 56 is arranged, in a compressed manner, between an upper face of the contact portion 57 of the heat radiating plate 55 and the top plate portion 53 of the fixture body 12, and presses the heat radiating plate 55 downward.

By attaching the lamp device 14 to the socket device 13, the contact portion 57 of the heat radiating plate 55 is brought into contact with the end face 43 of the projection portion 42 of the cap portion 38 and the contact portion 57 of the heat radiation plate 55 is pressed against and brought into close face-contact with the end face 43 of the projection portion 42 of the cap portion 38 by the spring 56.

Therefore, when the lamp device 14 is lit, heat generated by the LEDs 35 is conducted from the light-emitting module substrate 50 to the cap portion 38, efficiently conducted from the end face 43 of the projection portion 42 to the heat radiating plate 55 and efficiently radiated into air or the like.

Accordingly, even in the state that the lamp device 14 is attached to the socket device 13 of the fixture body 12, heat of the lamp device 14 can be efficiently radiated from the cap portion 38.

Although the spring 56 is used as the pressing body, the heat radiating plate 55 may be brought into close contact with the end face 43 of the projection portion 42 by elasticity of the heat radiating plate 55 itself. In this case, the spring 56 may be removed and the heat radiating plate 55 can be made to serve as the pressing body.

Figure 6:
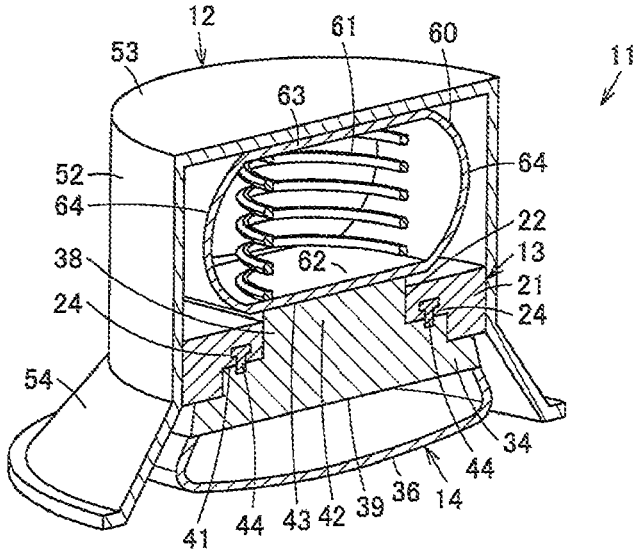
FIG. 6 is a perspective view of a vertical cross section of a lighting fixture according to a third embodiment of the present invention.
Figure 7:
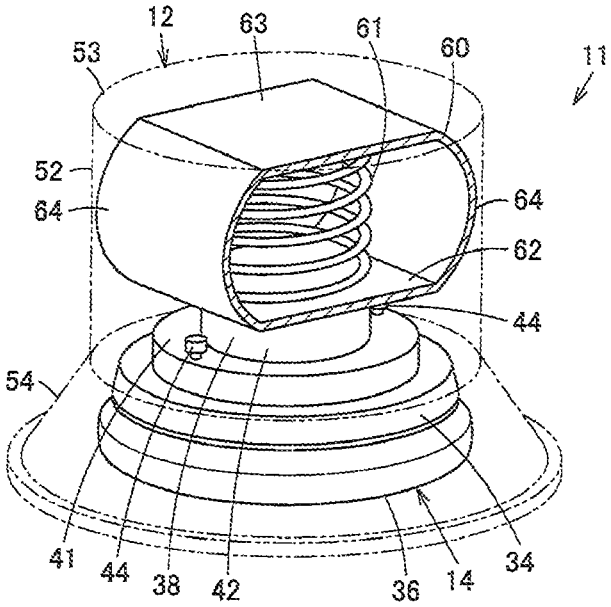
FIG. 7 is a perspective view of the partially seen through lighting fixture.

Next, FIG. 6 is a perspective view of a cross section of a part of a lighting fixture and FIG. 7 is a perspective view of a partially seen through lighting fixture, according to a third embodiment.

A lighting fixture 12 of the third embodiment has the same structure as that of the second embodiment. A heat radiating plate 60 as a heat radiating body and a spring 61 as a pressing body are arranged in the space between the upper face of the socket device 13 and the top plate portion 53 of the fixture body 12.

The heat radiating plate 60 is made of metal, for example, copper, and formed in a ring shape. That is, the heat radiating plate 60 includes: a flat contact portion 62, which comes into face-contact with the end face 43 of the projection portion 42 of the cap portion 38 of the lamp device 14, at its lower face; a flat contact portion 63, which comes into face-contact with the fixture body 12, at its upper face; and curved side face portions 64 which are formed between both sides of the contact portions 62 and 63 so as to make expansion and contraction of an interval between the contact portions 62 and 63.

The spring 61 is, in a compressed manner, arranged inside the heat radiating plate 60 and between the upper and lower contact portions 62 and 63.

By attaching the lamp device 14 to the socket device 13, the end face 43 of the projection portion 42 of the cap portion 38 projects from the upper face of the socket device 13 and comes into contact with the contact portion 62 of the lower face of the heat radiating plate 60. By the spring 61 arranged inside the heat radiating plate 60, the contact portion 62 of the lower face of the heat radiating plate 60 is pressed against and brought into close face-contact with the end face 43 of the projection portion 42 of the cap portion 38, and the contact portion 63 of the upper face of the heat radiating plate 60 is pressed against and brought into close face-contact with the fixture body 12.

Therefore, when the lamp device 14 is lit, heat generated by the LEDs 35 is conducted from the light-emitting module substrate 50 to the cap portion 38, efficiently conducted from the end face 43 of the projection portion 42 to the heat radiating plate 60, efficiently conducted from the heat radiating plate 60 to the fixture body 12 and efficiently radiated from the fixture body 12 into air or the like.

Accordingly, even in the state that the lamp device 14 is attached to the socket device 13 on the fixture body 12, heat of the lamp device 14 can be efficiently radiated from the cap portion 38.

Moreover, although the spring 61 is used as the pressing body, the heat radiating plate 60 may be brought into close contact with the end face 43 of the projection portion 42 by elasticity of the heat radiating plate 60 itself. In this case, the spring 61 may be removed and the heat radiating plate 60 can be made to serve as the pressing body.

Figure 8:
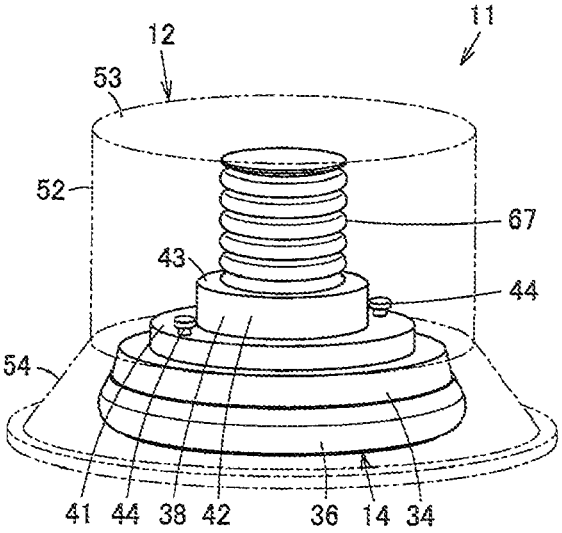
FIG. 8 is a perspective view of a lighting fixture, which is partially seen through, according, to a fourth embodiment of the present invention.

Next, FIG. 8 is a perspective view of a partially seen through lighting fixture, according to a fourth embodiment.

A lighting fixture 12 of the fourth embodiment has the same structure as those of the second and third embodiments. A heat radiating member 67 serving as a heat radiating body and a pressing body is arranged in the space between the upper face of the socket device 13 and the top plate portion 53 of the fixture body 12. The heat radiating member 67 is made of metal, for example, copper, formed in the shape of a cylindrical bellows and arranged between the upper face of the socket device 13 and the top plate portion 53 of the fixture body 12 with the member 67 compressed.

By attaching the lamp device 14 to the socket device 13, the end face 43 of the projection portion 42 of the cap portion 38 projects from the upper face of the socket device 13 and comes into contact with a lower portion of the heat radiating member 67. By elasticity of the heat radiating member 67, the lower portion of the heat radiating member 67 is brought into close contact with the end face 43 of the projection portion 42 and an upper portion of the heat radiating member 67 is brought into close contact with the fixture body 12.

Therefore, when the lamp device 14 is lit, heat generated by the LEDs 35 is conducted from the light-emitting module substrate 50 to the cap portion 38, efficiently conducted from the end face 43 of the projection portion 42 to the heat radiating member 67, efficiently conducted from the heat radiating member 67 to the fixture body 12 and efficiently radiated from the fixture body 12 into air or the like.

Accordingly, even in the state that the lamp device 14 is attached to the socket device 13 of the fixture body 12, heat of the lamp device 14 can be efficiently radiated from the cap portion 38.

Further, since the one heat radiating member 67 serves as the heat radiating body and the pressing body, the number of components can be reduced.

Moreover, it is allowed that the reflecting plate portion 54 is separated from the fixture body 12 and detachably attached to the lamp device 14. Therefore, heat of the lamp device 14 is conducted to the reflecting plate portion 54, and heat radiation performance can be improved. Further, the lamp device 14 can be attached to/detached from the socket device 13 by handling the reflecting plate portion 54 and operability can be improved.

Figure 9:
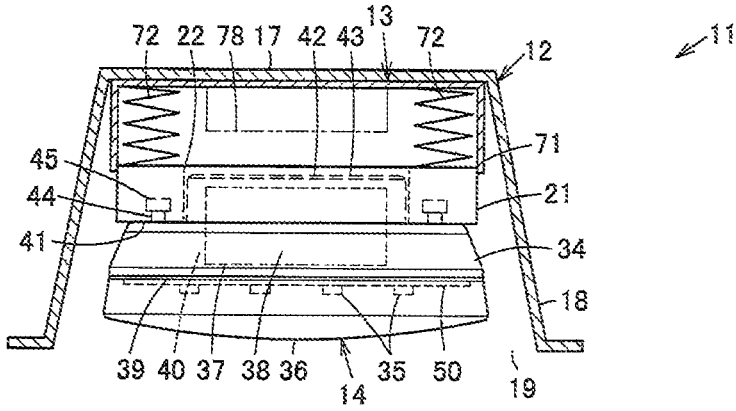
FIG. 9 is a cross sectional view of a lighting fixture, in which a socket body of a socket device is arranged at a projecting position, according to a fifth embodiment of the present invention.
Figure 10:
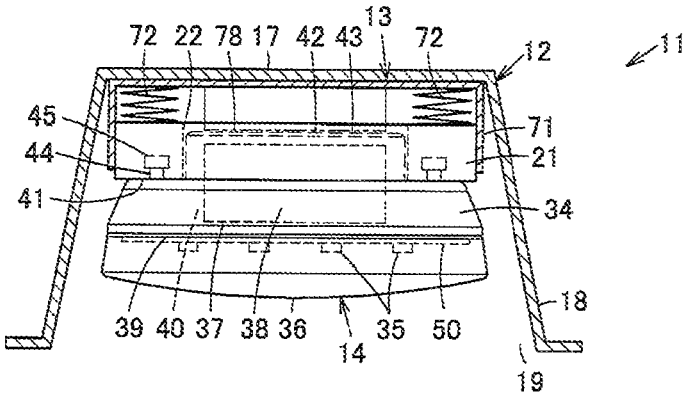
FIG. 10 is a cross sectional view of the lighting fixture in which the socket body of the socket device is arranged at a housing position.
Figure 11:
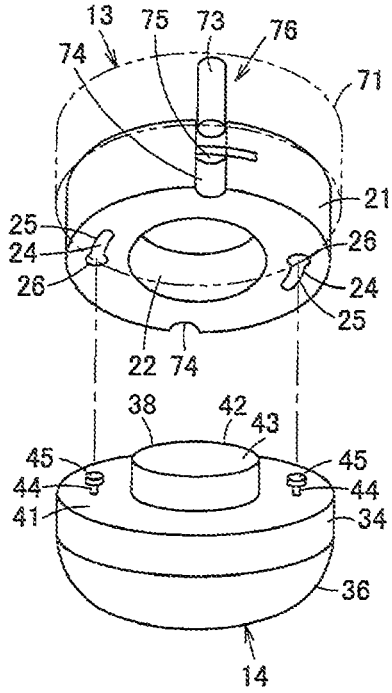
FIG. 11 is a perspective view showing a state that a lamp device is attached to/detached from the socket body, which is arranged at the projecting position of the socket device.
Figure 12:
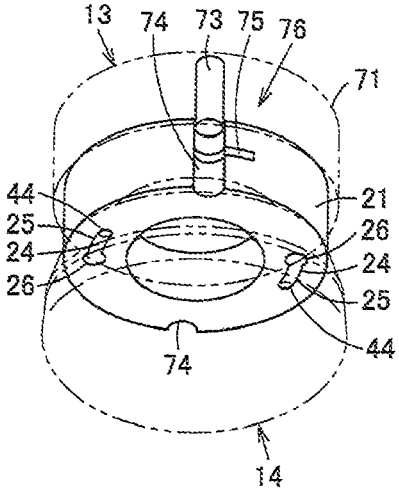
FIG. 12 is a perspective view showing a state that the lamp device is attached to the socket body, which is arranged at the projecting position of the socket device.
Figure 13:
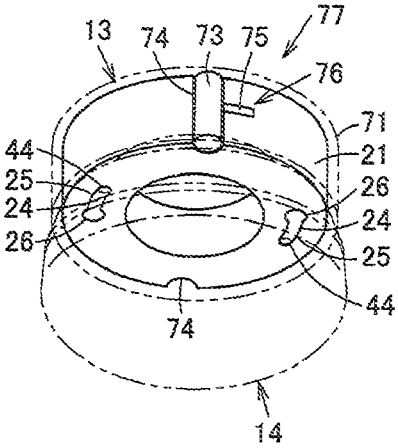
FIG. 13 is a perspective view showing a state that the socket body of the socket device is moved to the housing position.

Next, FIGS. 9 to 13 show a lighting fixture according to a fifth embodiment. FIG. 9 is a cross sectional view of the lighting fixture in which a socket body of the socket device is arranged at a projecting position. FIG. 10 is a cross sectional view of the lighting fixture in which the socket body of the socket device is arranged at a housing position. FIG. 11 is a perspective view showing a state before the lamp device 11 is attached to the socket body, which is arranged at the projecting position of the socket device. FIG. 12 is a perspective view showing a state that the lamp device is attached to the socket body, which is arranged at the projecting position of the socket device. FIG. 13 is a perspective view showing a state that the socket body of the socket device is moved to the housing position.

The socket device 13 includes a socket support body 71 attached to the flat plate portion 17 of the fixture body 12 and a socket device body 21 supported vertically movably in relation to the socket support body 71.

The socket support body 71 is made of, for example, metal, and opened downward, and the socket device body 21 is fitted in the socket support body 71 so as to be vertically movable. That is, by the socket support body 71, the socket device body 21 is movably supported between the housing position where the socket device body 21 is housed in the socket support body 71 and the projecting position where the body 21 projects downward from the socket support body 71.

Springs 72 as an energizing unit for energizing the socket device body 21 to the projecting position are arranged between the socket support body 71 and the socket device body 21, and a stopper (not shown) for regulating projection of the socket device body 21 at the projecting position is provided on a socket support body 71.

A locking unit (not shown) for locking the socket device body 21 at the housing position is provided between the socket support body 71 and the socket device body 21. The locking unit functioning like, for example, a push button switch, locks the socket device body 21 to the housing position by pushing upward and moving the socket device body 21 from the projecting position to the housing position with use of the lamp device 14. In addition, the locking unit unlocks the socket device body 21 by further slightly pushing upward the socket device body 21 with use of the lamp device 14 and allows the socket device body 21 to move down from the housing position to the projecting position. Although action of such a locking unit can be realized by using a spring for energizing the socket device body 21 into the socket support body 71, and a cam mechanism for regulating a rotation angle or the like, another well-known mechanism may be used as the locking unit.

A plurality of columnar ribs 73 each having a vertical axis are projected on an inner circumferential portion of the socket support body 71, groove portions 74 each of which has a semicircular cross section and engages with each rib 73 are vertically formed at a plurality of locations of an outer circumferential portion of the socket device body 21, and a locking member 75 is arranged aside of each groove portion 74 so as to be capable of entering/exiting the groove portion 74. The locking member 75 enters/exits the groove portion 74 in conjunction with turning operation of the lamp device 14 when the lamp device 14 is attached to/detached from the socket device body 21 held at the projecting position, and can be constituted by, for example, the below-described cam mechanism coming into contact with the lamp pin 44. In a state that the lamp device 14 is not attached to the socket device body 21 located at the projecting position, the locking member 75 enters the groove portion 74 and, when the socket device body 21 starts moving from the projecting position to the housing position, comes into contact with the rib 73 so as to restrict the movement of the socket device body 21. In a state that the lamp device 14 is connected to the socket device body 21 located at the projecting position, the locking member 75 exits the groove portion 74 and allows the socket device body 21 to move from the projecting position to the housing position. Accordingly, the ribs 73, the groove portions 74, the locking members 75 or the like constitute lock units 76 which allow the socket device body 21, to which the lamp device 14 is attached, to move between the projecting position and the housing position and to restrict the socket device body 21, to which the lamp device 14 is not attached, from moving from the projecting position to the housing position.

In a state that the socket device body 21 moves to the housing position, each rib 73 is positioned in a region, where the locking member 75 enters, in the groove portion 74, the locking member 75 cannot enter the groove portion 74, the lamp device 14 interlocking with the locking members 75 cannot be turned in a direction of being detached from the socket device body 21. Accordingly, the ribs 73, the groove portions 74, the locking members 75 or the like constitute a lamp device holding unit 77 for restricting the lamp device 14 from coming off from the socket device body 21 moved to the housing position.

A thermally conductive member 78, to which the lamp device 14 is thermally conductively connected by movement of the socket device body 21, to which the lamp device 14 is attached, to the housing position, is arranged on the socket support body 71.

As shown in FIGS. 9 and 11, the socket device body 21, to which the lamp device 14 is not attached, of the socket device 13 is projected downward in relation to the socket support body 71 (located at the projecting position), located in the vicinity of the opening portion 19 side of a lower face of the fixture body 12 and held at the projecting position by energization of the springs 72.

The locking member 75 on the socket device body 21 is located below the rib 73 and enters the groove portion 74, and an upper face of the locking member 75 faces a top end face of the rib 73.

In order to attach the lamp device 14 to the socket device 13, the lamp device 14 is raised so that each lamp pin 44 of the lamp device 14 is aligned with and inserted into the enlarged diameter portion 26 of each connection hole 25 of the socket device body 21. Even if each lamp pin 44 of the lamp device 14 is not aligned with the enlarged diameter portion 26 of each connection hole 25 of the socket device body 21 and pushes upward the socket device body 21, each locking member 75 comes into contact with the top end face of the rib 73. Accordingly, the socket device body 21 is prevented from moving upward to the housing position, and thus the lamp device 14 can be prevented from being hardly attached to the socket device 13.

After each lamp pin 44 of the lamp device 14 is inserted into the enlarged diameter portion 26 of the connection hole 25 of the socket device body 21, the lamp device 14 is turned in the attachment direction and attached to the socket device body 21 as shown in FIG. 12.

When the lamp device 14 is thus attached to the socket device body 21, the socket device body 21 is located at the projecting position and in the vicinity of the opening portion 19 side of the lower face of the fixture body 12. Therefore, a space into which fingers are inserted can be formed between a circumferential portion of the lamp device 14 to be attached to the socket device body 21 and the reflecting plate portion 18 of the fixture body 12, and the lamp device 14 can be, being held by hand, easily attached to the socket device body 21.

By turning the lamp device 14 in the attachment direction, the locking members 75 exit the groove portions 74 in accordance therewith, and the socket device body 21 is allowed to move to the housing position.

After the lamp device 14 is attached to the socket device body 21, the lamp device 14 is pushed upward, and thus the socket device body 21 is pushed upward to the housing position and the lamp device 14 can be held at a predetermined attachment position in the fixture body 12 as shown in FIGS. 10 and 13. The socket device body 21 moved to the housing position is locked by the locking unit.

The socket device body 21 to which the lamp device 14 is attached is moved to the housing position, and thus the cap portion 38 of the lamp device 14 is brought into close face-contact with the thermally conductive member 78 and the lighting fixture 11 is thereby in a use state.

Since the cap portion 38 of the lamp device 14 is brought into close face-contact with the thermally conductive member 78 although heat is generated when the LEDs 35 of the lamp device 14 are lit, the heat generated from the lamp device 14 is efficiently conducted to the fixture body 12 via the thermally conductive member 78 and heat radiation performance of the lamp device 14 can be improved.

In the state that the socket device body 21 is located at the housing position, each rib 73 is positioned in the region, where the locking member 75 enters, in the groove portion 74, the locking member 75 cannot enter the groove portion 74, and the lamp device 14 interlocking with the locking members 75 cannot be turned in the direction of being detached from the socket device body 21.

On the other hand, in the case of detaching the lamp device 14, the socket device body 21 located at the housing position is slightly pushed upward via the lamp device 14 so that the lock by the locking unit is canceled, and thus moved downward to the projecting position together with the lamp device 14 by the energization of the spring 72.

When the socket device body 21 is moved downward to the projecting position, the lamp device 14 is turned in the detachment direction and then moved downward, and thus the lamp pins 44 of the lamp device 14 are pulled out from the connection holes 25 of the socket device body 21 and the lamp device 14 can be detached from the socket device body 21.

When the socket device body 21 is moved downward to the projecting position, each locking member 75 on the socket device body 21 moves further downward than the rib 73 and thus enters the groove portion 74 in accordance with turning of the lamp device 14 in the detachment direction, and the socket device body 21 is restricted from moving to the housing position.

The socket device body 21 of the socket device 13 can thus be moved between the housing position where it is housed in the socket support body 71 side and the projecting position where it projects from the socket support 71 side. Accordingly, even if the socket device 13 is used for a small lighting fixture, the socket device body 21 is moved to the projecting position in relation to the socket support body 71 attached to the fixture body 12 side, and thus the lamp device 14 can be, with the circumferential portion of the lamp device 14 gripped, easily detached.

By the lamp device holding unit 77, the lamp device 14 is restricted from coming off from the socket device body 21 moved to the housing position and thus the lamp device 14 attached to the socket device 13 can be prevented from coming off from the socket device 13, and, when the lamp device 14 is detached, the socket device 13 can be reliably held at the projecting position and the lamp device 14 can be easily attached.

Figure 14:
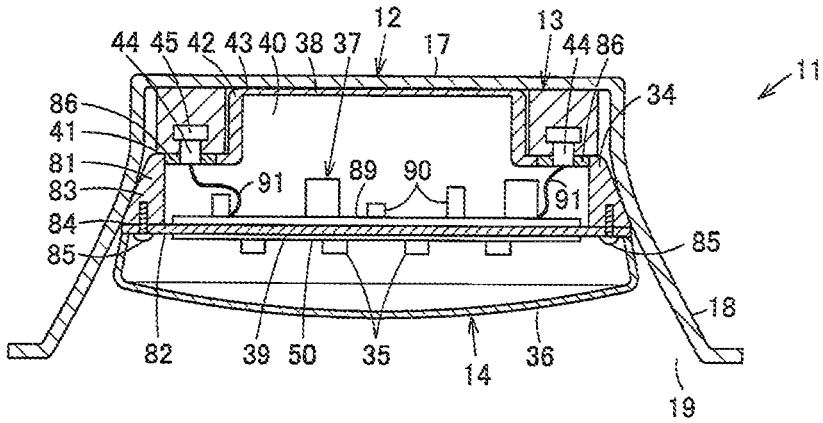
FIG. 14 is a cross sectional view of a lighting fixture according to a sixth embodiment of the present invention.

Next, FIG. 14 is a cross sectional view of a lighting fixture according to a sixth embodiment.

The whole lamp device body 34 of the lamp device 14 is formed of metal such as aluminum excellent in heat radiation performance, made of, for example, an aluminum die casting, and divided into a cap side metallic part 81 constituting the cap portion 38 and a light source side metallic part 82 constituting the substrate attachment portion 39. The cap side metallic part 81 is formed in the shape of a disk opened downward, and a contact face 84 with which the light source side metallic part 82 comes into contact is formed at an end face of an annular outer circumferential portion 83 of the metallic part 81. The light source side metallic part 82 is formed in a flat disk shape so as to close an opening of a lower face of the cap side metallic part 81, and an upper face of a circumferential portion of the metallic part 82 can come into contact with the contact face of the cap side metallic part 81. The light source side metallic part 82 is fixed to the cap side metallic part 81 with a plurality of screws 85 as a thermal conduction connection unit, and is thermally conductively closely connected to the cap portion side metallic part 81 from the light source side metallic part 82.

An insulating member 86 is interposed between the cap side metallic part 81 of the lamp device body 34 and the lamp pin 44.

The light-emitting module substrate 50 on which the plurality of LEDs 35 are mounted is closely attached to the substrate attachment portion 39 of the lamp device body 34.

The lighting circuit 37 includes a lighting circuit substrate 89 and lighting circuit parts 90 mounted on the lighting circuit substrate 89, each lamp pin 44 is electrically connected to an input portion of the lighting circuit substrate 89 via a lead wire 91, and the light-emitting module substrate 50 is electrically connected to output portions of the lighting circuit substrate 89 via lead wires or the like. The lighting circuit substrate 89 is housed in the housing portion 40 of the lamp device body 34 via an insulating material (not shown).

In the case where the lamp device 14 is attached to the socket device 13, the outer circumferential portion 83 of the lamp device body 34 is thermally conductively brought into contact with the reflecting plate portion 18 of the fixture body 12, and the end face 43 of the projection portion 42 of the lamp device body 34 is thermally conductively brought into contact with the flat plate portion 17 of the fixture body 12.

Therefore, heat generated from the LEDs 35 is efficiently radiated when the LEDs 35 of the lamp device 14 are lit. That is, since the light-emitting module attachment portion 50 is brought into close contact with the substrate attachment portion 39 of the metallic lamp device body 34 and the substrate attachment portion 39 is thermally conductively connected to the cap portion 38 side with the screws 85 as the thermal conduction connection unit, the heat generated from the LEDs 35 can be efficiently conducted to the cap portion 38 side via the substrate attachment portion 39. The heat conducted to the cap portion 38 is conducted to the fixture body 12 coming into contact with the cap portion 38 and can be efficiently radiated from the fixture body 12.

Moreover, a plurality of slits for dividing the reflecting plate portion 18 in a circumferential direction may be provided in the reflecting plate portion 18, and the outer circumferential portion 83 of the lamp device body 34 may be brought into close contact with the reflecting plate portion 18 by imparting elasticity to pieces into which the reflecting plate portion 18 is divided. Further, a metallic spring member coming into close contact with the outer circumferential portion 83 of the lamp device body 34 may be separately provided so that heat can be conducted.

Figure 15:
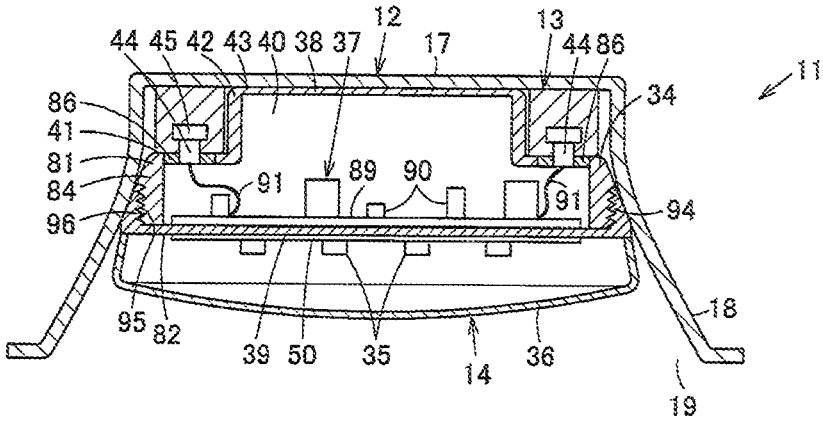
FIG. 15 is a cross sectional view of a lighting fixture according to a seventh embodiment of the present invention.

Next, FIG. 15 is a cross sectional view of a lighting fixture according to a seventh embodiment.

Screw engaging portions 94 are used as a thermal conduction connection unit for thermally conductively connecting the substrate attachment portion 39 side of the lamp device body 34 to the cap portion 38 side of the lamp device body 34. That is, a screw portion 95 is formed at the outer circumferential portion 83 of the cap side metallic part 81, and a screw portion 96 for engaging with the screw portion 95 of the cap side metallic part 81 is formed at a circumferential edge portion of the light source side metallic part 82.

Also when a screw-engagement structure is used as a thermal conduction connection unit, heat can be efficiently conducted from the substrate attachment portion 39 side to the cap portion 38 side.

Moreover, it is allowed that the lamp device body 34 is vertically divided by a dividing line in a height direction passing the center of the lamp device body 34 and pieces of the divided lamp device bodies are joined to each other by screw-clamping or the like. In this case, the substrate attachment portion 39 side and the cap portion 38 side are integrally constructed as the thermal conduction connection unit, so that heat can be efficiently conducted from the substrate attachment portion 39 side to the cap portion 38 side.

Figure 16:
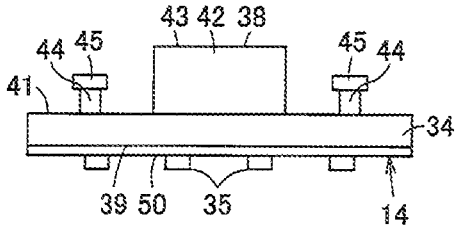
FIG. 16 is a side view of a lamp device of a lighting fixture according to an eighth embodiment of the present invention.
Figure 17:
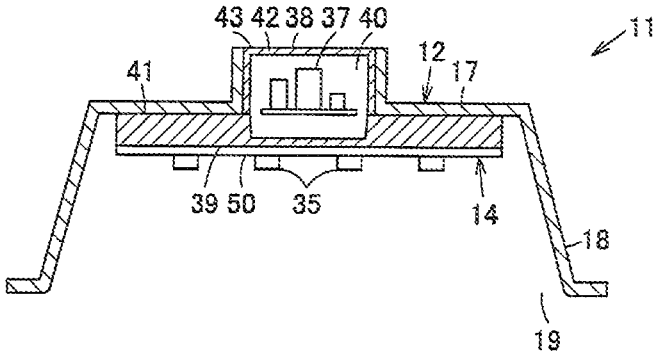
FIG. 17 is a cross sectional view of the lighting fixture of the eighth embodiment.

Next, FIG. 16 is a side view of a lamp device and FIG. 17 is across sectional view of the lighting fixture, according to an eighth embodiment.

The flat substrate attachment portion 39, to which the light-emitting module substrate 50 is thermally conductively attached, is formed on the lower face of the cap portion 38 on the lamp device body 34, and the housing portion 40 for housing the lighting circuit 37 is formed inside the projection portion 42 of the cap portion 38. The lamp pins 44 are connected to the lighting circuit 37 in a state that grooves are formed on the substrate attachment portion 39 and lead wires for connecting the lamp pins 44 to the lighting circuit 37 are arranged on the grooves. A part or whole of the projection portion 42 on the lamp device body 34 is divisionally formed so that the lighting circuit 37 can be housed in the housing portion 40.

By attaching the lamp device 14 to the socket device 13, the contact face 41 of the cap portion 38 of the lamp device 14 is thermally conductively brought into close contact with the fixture body 12. In this case, opening portions are formed in the fixture body 12 in accordance with positions of the lamp pins 44 of the lamp device 14, the socket device 13 is arranged so as to face the opening portions, and the lamp pins 44 can be attached to the socket device 13 without coming into contact with the fixture body 12.

Since the substrate attachment portion 39 side and the cap portion 38 side are integrally constituted as the thermal conduction connection unit, heat can be efficiently conducted from the substrate attachment portion 39 side to the cap portion 38 side.

Heat conducted to the cap portion 38 is efficiently conducted to the fixture body 12 with which the contact face 41 of the cap portion 38 comes into contact, and can be efficiently radiated.

Moreover, the lighting circuit 37 may be arranged on the lower face side of the lamp device body 34 together with the LEDs 35. In this case, it is unnecessary to provide the housing portion 40 for housing the lighting circuit 37 in the lamp device body 34 and to divisionally form the lamp device body 34, and the lamp device body 34 can be simplified.

Figure 18:
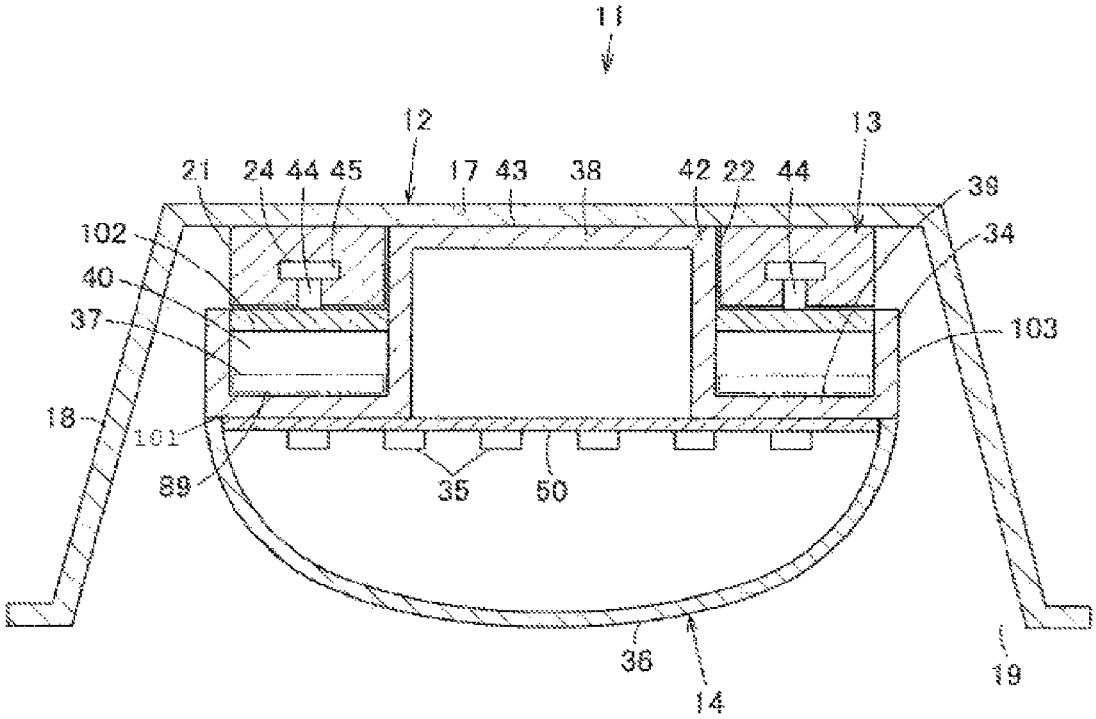
FIG. 18 is a cross sectional view of a lighting fixture according to a ninth embodiment of the present invention.
Figure 19:
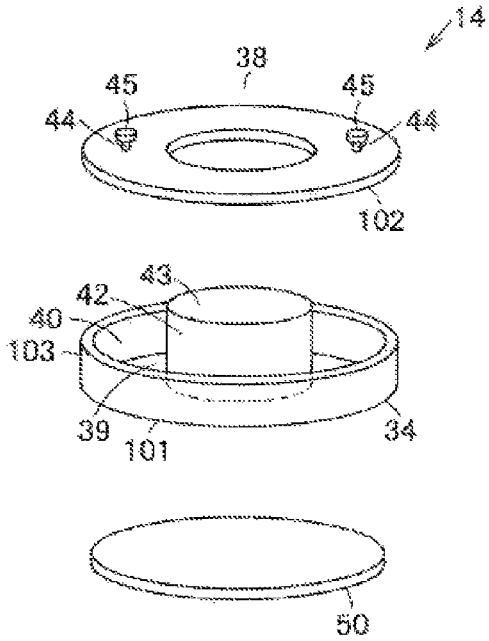
FIG. 19 is a perspective view of a disassembled lamp device shown in FIG. 18.

FIG. 18 is a cross sectional view of a lighting fixture and FIG. 19 is a perspective view of the disassembled lamp device, according to a ninth embodiment.

The cap portion 38 of the lamp device 14 includes a base 101, a cover 102 attached to the base 101 and a pair of lamp pins 44 projecting from the cover 102.

The base 101 is made of, for example, metal such as aluminum excellent in thermal conductivity, and constituted by integrally forming the flat disk-shaped (annular) substrate attachment portion 39, the cylindrical projection portion 42 projecting from the center of an upper face of the substrate attachment portion 39 and an annular wall portion 103 projecting from a circumferential portion of the upper face of the substrate attachment portion 39 with each other. The annular housing portion 40 for housing the lighting circuit 37 is formed between the projection portion 42 and the wall portion 103 on the upper face of the substrate attachment portion 39. The light-emitting module substrate 50 is screwed to a lower face of the substrate attachment portion 39 of the base 101 so as to come into close face-contact therewith.

The cover 102 is made of insulative synthetic resin and formed in a ring shape. The cover 102 is attached so as to close an upper face of the housing portion 40 on the base 101.

The lighting circuit 37 has the annularly formed lighting circuit substrate 89 and is housed and attached into the housing portion 40 on the cap portion 38 via an insulating member (not shown).

In the state that the lamp device 14 is attached to the socket device 13, the projection portion 42 of the lamp device 14 is inserted into the connection hole 22 of the socket device 13, and the end face 43 of the projection portion 42 is thermally conductively brought into contact with the flat plate portion 17 of the fixture body 12. Here, it is allowed that a plurality of slits for dividing a part of the flat plate portion 17 of the fixture body 12 are provided in the flat plate portion 17 so as to impart elasticity to small pieces of the divided flat plate portion 17 and the small pieces are thermally conductively brought into contact with the end face 43 of the projection portion 42. Alternatively, it is allowed that a metallic spring member to be brought into close contact with the end face 43 of the projection portion 42 is separately provided so that the flat plate portion 17 is thermally conductively brought into contact with the end face 43.

When the LEDs 35 of the lamp device 14 are lit, heat generated by the LEDs 35 is efficiently conducted from the light-emitting module substrate 50 to the substrate attachment portion 39 of the base 101 of the cap portion 38 and efficiently conducted to the projection portion 42 formed integrally with the substrate attachment portion 39 of the base 101. The heat conducted to the projection portion 42 is efficiently conducted from the end face 43 of the projection portion 42 to the fixture body 12 and radiated into air.

Therefore, heat generated by the LEDs 35 and conducted to the substrate attachment portion 39 of the base 101 can be efficiently conducted to the projection portion 42 formed integrally with the substrate attachment portion 39, concentrated to the projection portion 42 and efficiently made to escape the same from the projection portion 42 to the fixture body 12, and heat radiation performance can be improved.

On the other hand, the heat conducted to the substrate attachment portion 39 of the base 101 is also efficiently conducted to the wall portion 103 formed integrally with the substrate attachment portion 39, and radiated from the wall portion 103 into air. Therefore, radiation performance of heat generated by the LEDs 35 can be improved.

Accordingly, the lamp device 14 of the ninth embodiment obtains sufficient heat radiation performance, can restrict the temperature of the LEDs 35 from rising, and can prevent the LED 35 from being thermally deteriorated and having a short life and, in some cases, light-emitting efficiency from being lowered.

Figure 20:
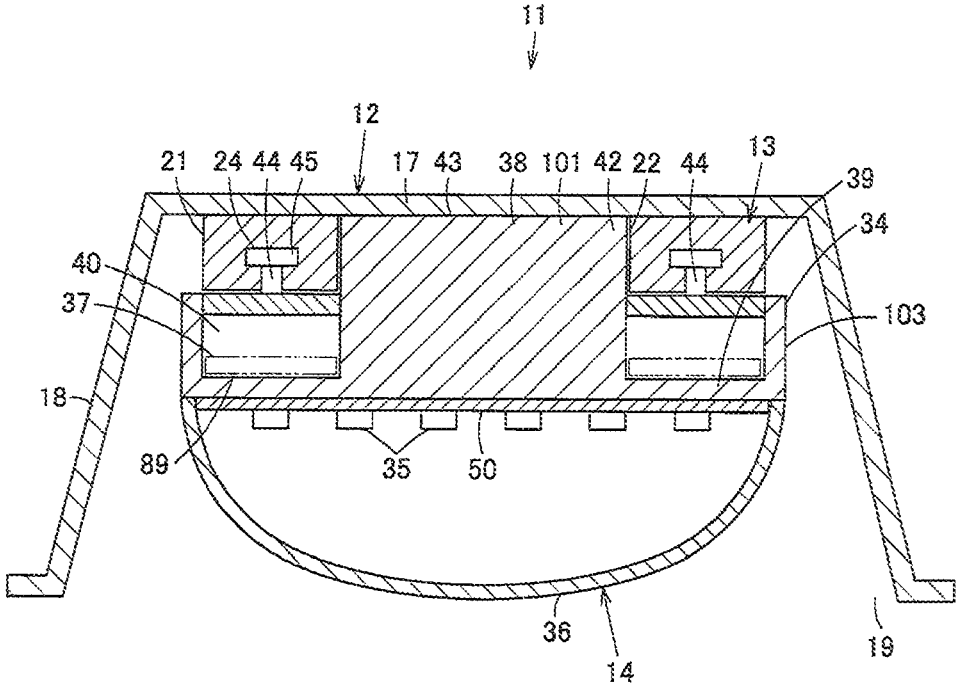
FIG. 20 is a cross sectional view of a lighting fixture according to a tenth embodiment of the present invention.

Next, FIG. 20 is a cross sectional view of a lighting fixture according to a tenth embodiment.

In the lamp device 14, the projection portion 42 of the base 101 of the cap portion 38 is solidly formed in a columnar shape. In the case where the lamp device 14 is constituted as described above, the contact area between the projection portion 42 and the substrate attachment portion 39 is increased and thermally conductive efficiency is raised, and thus heat generated by the LEDs 35 is easily conducted from the light-emitting module substrate 50 to the end face 43 of the projection portion 42. Therefore, thermal conductivity from the substrate attachment portion 39 to the projection portion 42 can be improved, and, consequently, radiation performance of heat generated by the LEDs 35 can be further improved.

Figure 21:
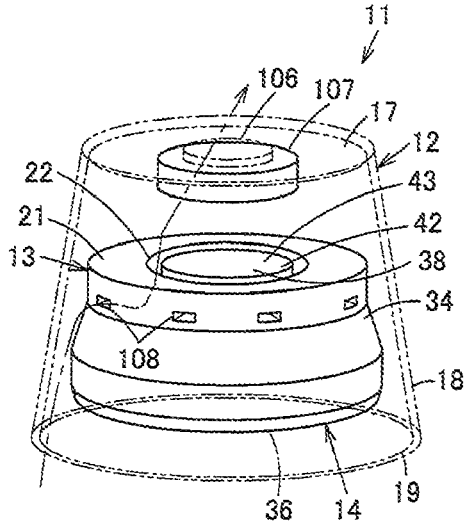
FIG. 21 is a perspective view of a lighting fixture according to an eleventh embodiment of the present invention.

Next, FIG. 21 is a perspective view of a lighting fixture according to an eleventh embodiment.

An exhaust hole 106 is formed in the flat plate portion 17 of the fixture body 12, and a fan 107 for discharging air in the fixture body 12 from the exhaust hole 106 to the outside is arranged on the flat plate portion 17.

A plurality of vents 108 for making an outer peripheral face of the socket device body 21 communicate with an inner peripheral face of the insertion hole 22 are provided in the socket device 13.

Action of the fan 107 generates an air flow that air under the fixture body 12 is sucked into the fixture body 12 from the opening portion 19 of the lower face of the fixture body 12, passes through the plurality of vents 108 of the socket device 13, flows upward through a gap between the inner peripheral face of the insertion hole 22 and the projection portion 42, which is inserted into the insertion hole 22, of the lamp device 14, and is discharged upward from the exhaust hole 106 of the fixture body 12.

The air flow allows heat conducted to the projection portion 42 to be efficiently radiated into air, and, consequently, radiation performance of heat generated by the LEDs 35 to be improved.

Figure 22:
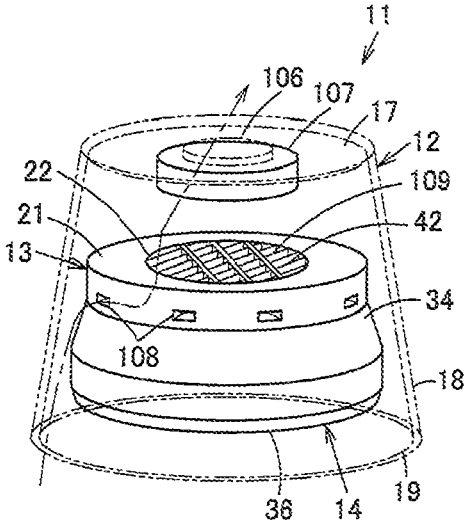
FIG. 22 is a perspective view of a lighting fixture according to a twelfth embodiment of the present invention.

Next, FIG. 22 is a perspective view of a lighting fixture according to a twelfth embodiment.

Fins 109 are provided on projection portion 42 of the lamp device 14 of the eleventh embodiment shown in FIG. 21. The contact area between heat conducted to the projection portion 42 and air flowing by the action of the fan 107 is increased by the fins 109, and heat radiation performance can be further improved.

Figure 23:
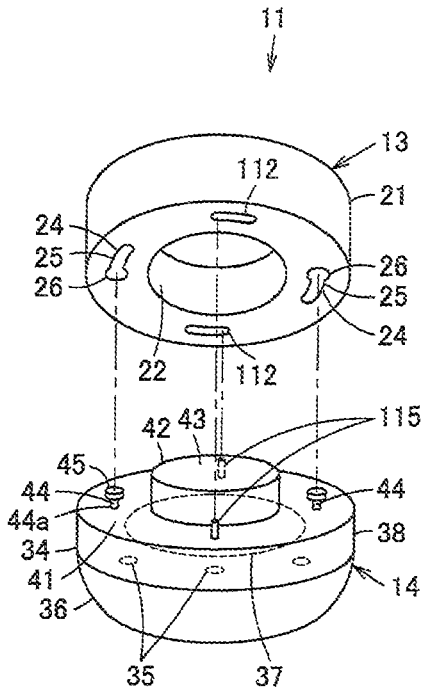
FIG. 23 is a perspective view of a lamp device and a socket device, which are detached from each other, of a lighting fixture according to a thirteenth embodiment of the present invention.
Figure 24:
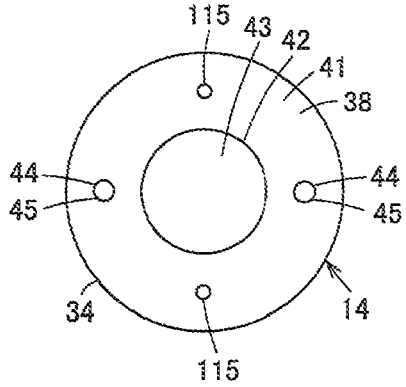
FIG. 24 is a plan view of the lamp device shown in FIG. 23.
Figure 25:
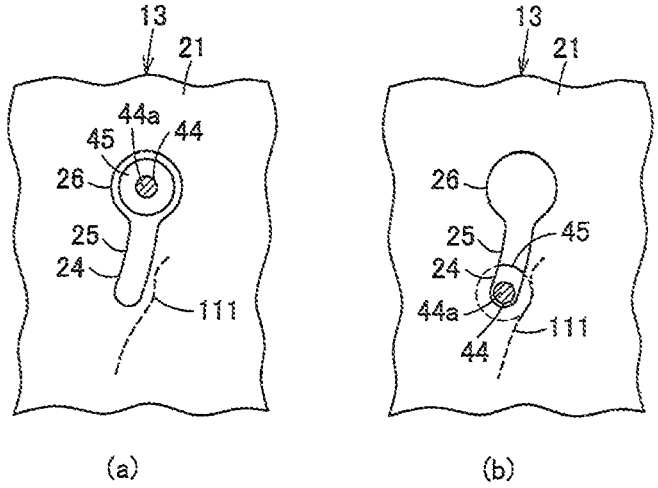
FIGS. 25(*a*) and 25(*b*) are partial cross sectional views each showing a relationship between a lamp pin of the lamp device and a power supplying portion of the socket device.
Figure 26:
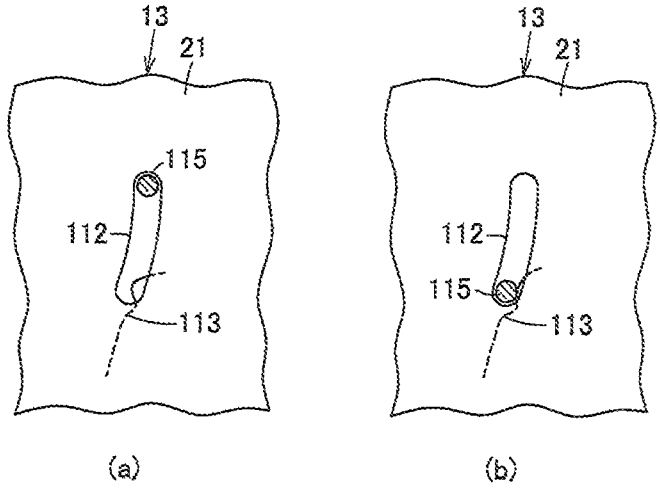
FIGS. 26(*a*) and 26(*b*) are partial cross sectional views each showing a relationship between a signal terminal of the lamp device and a signal transmitting portion of the socket device.
Figure 27:
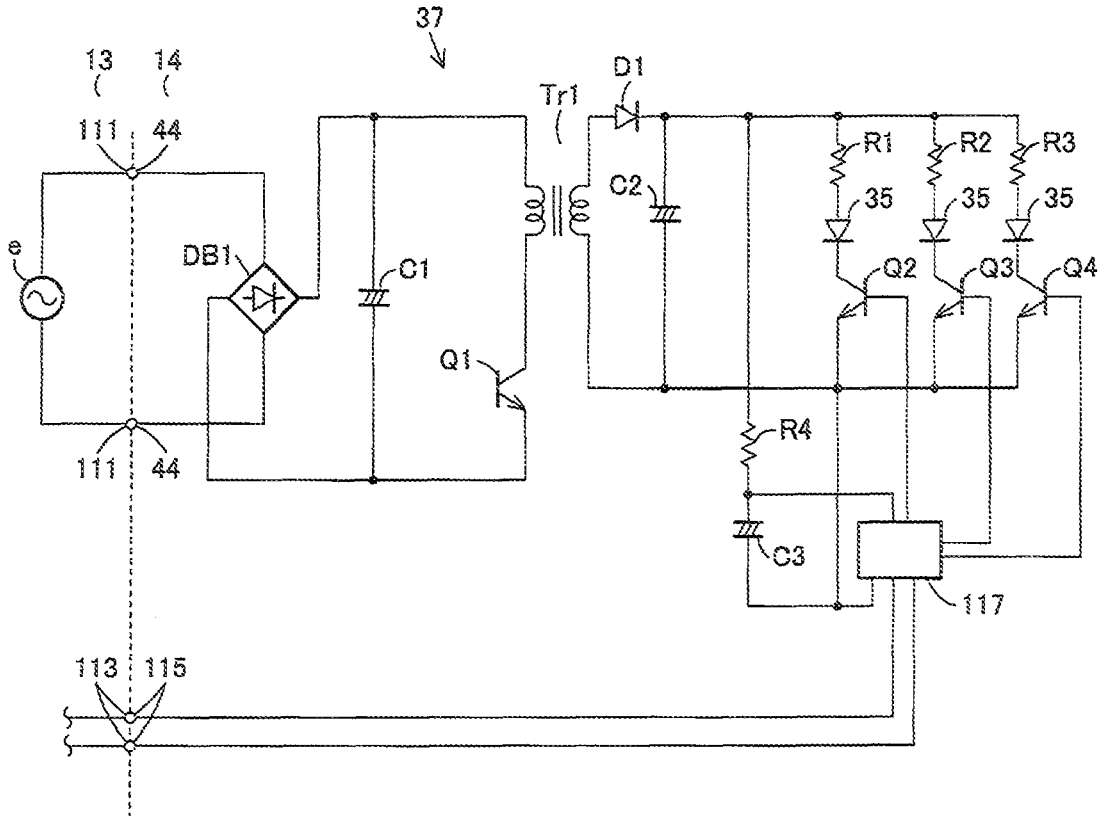
FIG. 27 is a circuit diagram of the lighting fixture shown in FIG. 23.

FIGS. 23 to 27 show a lighting fixture according to a thirteenth embodiment, FIG. 23 is a perspective view of a disassembled lamp device and socket device, which are detached from each other, of a lighting fixture, FIG. 24 is a plan view of the lamp device, FIGS. 25(*a*) and 25(*b*) are partial cross sectional views each showing a relationship between the lamp pin of the lamp device and a power supplying portion of the socket device. FIGS. 26(*a*) and 26(*b*) are partial cross sectional views each showing a relationship between a signal terminal of the lamp device and a signal transmitting portion of the socket device, and FIG. 27 is a circuit diagram of the lighting fixture.

As shown in FIG. 23, the lighting fixture 11 is a downlight and includes a fixture body (not shown), the output adjustment type socket device 13 attached to the fixture body, and the lamp device 14 which is attachable to/detachable from the socket device 13 and has an output adjusting function.

On the lower face of the socket device body 21 of the socket device 13, the pair of socket portions 24 are formed symmetrically with respect to the center of the socket device body 21. As shown in FIG. 25, the connection hole 25 for power supply is formed in the socket portion 24, and a power supplying bracket 111 as a power supplying portion for supplying power to the lamp device 14 is arranged at the inner side of the connection hole 25. The connection hole 25 is an arc-shaped oblong hole concentric with the socket device body 21, and the enlarged diameter portion 26 is formed at one end of the connect ion hole 25. The power supplying bracket 111 is arranged on a side portion of the other end side of the connection hole 25 at a position of being not touched from the outside of the connection hole 25.

As shown in FIG. 23, in the lower face of the socket device body 21, a pair of signal connection holes 112 are formed so as to be orthogonal to the pair of socket portions 24 and symmetric with respect to the center of the socket device body 21. As shown in FIG. 26, a signal bracket 113 as a signal transmitting portion for transmitting a signal to the lamp device 14 is arranged at the inner side of the connection hole 112. The connection hole 112 is an arc-shaped oblong hole concentric with the socket device body 21, and a large diameter portion may be provided at one end side of the hole 112. The signal brackets 113 are arranged so that a part thereof enters the connection hole 112 at the other end side of the connection hole 112.

Power source wires arranged on the fixture body 12 are electrically connected to the power supplying brackets 111, and signal lines extending from a controller (not shown) or the like are electrically connected to the signal brackets 113.

As shown in FIGS. 23 and 24, the pair of conductive metallic lamp pins 44 symmetric with respect to the center of the lamp device 14 is projected on the contact face 41 of the cap portion 38 of the lamp device 14. In the lamp pins 44, a shaft portion 44*a* and the large diameter portion 45 located at a top end of the shaft portion 44*a* are formed. When the lamp device 14 is attached to the socket device 13, the large diameter portion 45 of each lamp pin 44 is inserted into the enlarged diameter portion 26 of each connection hole 25 of the socket device 13 as shown in FIG. 25(*a*), the shaft portion 44*a* of the lamp pin 44 is moved to the side opposite from the enlarged diameter portion 26 in the connection hole 25 by turning of the lamp device 14 as shown in FIG. 25(*b*), and thus a peripheral face of the large diameter portion 45 of the lamp pin 44 is brought into contact with and electrically connected to the power supplying bracket 111, the large diameter portion 45 is hooked to the edge portion of the connection hole 25 and the lamp device 14 is held by the socket device 13.

A pair of conductive metallic signal terminals 115 are projected on the contact face 41 of the cap portion 38 of the lamp device 14, the terminals 115 being orthogonal to the pair of lamp pins 44 and symmetric with respect to the center of the lamp device 14. The signal terminal 115 is constituted by a columnar pin. When the lamp device 14 is attached to the socket device 13, each signal terminal 115 is inserted into one end of each connection hole 112 of the socket device 13 as shown in FIG. 26(*a*), moved to the other end side of the connection hole 112 by turning of the lamp device 14, and thus brought into contact with and electrically connected to the signal brackets 113 as shown in FIG. 26(*b*).

The lighting circuit 37 includes the lighting circuit substrate, a power input side of the lighting circuit substrate and the lamp pins 44 are electrically connected to each other via lead wires or the like, and a lighting output side of the lighting circuit substrate and the light-emitting module substrate 50 are electrically connected to each other via lead wires or the like. Further, a control circuit for controlling output of the lighting circuit 37 is mounted on the lighting circuit substrate, and a signal input portion of the control circuit and the signal terminals 115 are electrically connected to each other via lead wires or the like.

Next, FIG. 27 shows a circuit diagram of the lighting fixture 11. The lighting fixture 11 controls light output of the LEDs 35 of the lamp device 14, here, subjects the LEDs 35 to light control, by a signal transmitted from the outside.

The power supplying brackets 111 of the socket device 13 are connected to a commercial power source e.

Input sides of a diode bridge DB1 which is a full-wave rectifier are connected to the lamp pins 44 of the lamp device 14.

To output sides of the diode bridge DB1, there are connected a smoothing capacitor C1 and a series circuit of a primary winding of a transformer Tr1 and an NPN-type transistor Q1 as a switching element for output control. The transistor Q1 is drive-controlled by a driving circuit, and thus direct current flowing to a secondary side of the transformer Tr1 is controlled.

A rectifying smoothing circuit including a rectifying diode D1 and a smoothing electrolytic capacitor C2 are connected to the secondary side of the transformer Tr1, and a plurality of series circuits of resistors R1, R2 and R3, the LEDs 35, and 35 and transistors Q2, Q3 and Q4 are connected in parallel to the rectifying smoothing circuit.

A series circuit of a resistor R4 and an electrolytic capacitor C3 are connected between the electrolytic capacitor C2 and the resistors R1, R2 and R3, and a control circuit 117 is connected in parallel to the electrolytic capacitor C3. PWM signals are supplied from the control circuit 117 to bases of the transistors Q2, Q3 and Q4 to PWM-control the transistors Q2, Q3 and Q4. A light control signal transmitted from the outside is input into the control circuit 117 through the signal brackets 113 of the socket device 13 and the signal terminals 115 of the lamp device 14.

Next, action of the lighting fixture 11 of the thirteenth embodiment will be described.

In order to attach the lamp device 14 having a light control function to the light control-type socket device 13, the large diameter portion 45 of each lamp pin 44 of the lamp device 14 is inserted into the enlarged diameter portion 26 of each connection hole 25 of the socket device 13 as shown in FIG. 25(*a*), and, simultaneously, each signal terminal 115 is inserted into one end of each connection hole 112 of the socket device 13 as shown in FIG. 26(*a*). By turning the lamp device 14 in the attachment direction in this state, as shown in FIG. 25(*b*), the shaft portion 44*a* of each lamp pin 44 is moved to the side opposite from the enlarged diameter portion 26 in the connection hole 25, the large diameter portion 45 of the lamp pin 44 is brought into contact with and electrically connected to the power supplying bracket 111, the large diameter portion 45 is hooked to the edge portion of the connection hole 25, and the lamp device 14 is held by the socket device 13. At the same time, as shown in FIG. 26(*b*), each signal terminal 115 is moved to the other end side of the connection hole 112, and brought into contact with and electrically connected to the signal brackets 113.

Accordingly, by attaching the lamp device 14 to the socket device 13, the lamp pins 44 of the lamp device 14 are electrically brought into contact with the power supplying brackets 111 of the socket device 13, and power can be supplied from the socket device 13 to the lamp device 14. At the same time, the signal terminals 115 of the lamp device 14 are electrically brought into contact with the signal brackets 113 of the socket device 13, and a signal can be transmitted from the socket device 13 to the lamp device 14.

By turning on the commercial power source e, current from the commercial power source e is rectified by the diode bridge DB1 and smoothed by the smoothing capacitor C1. Current flowing to a primary side of the transformer Tr1 is controlled by the transistor Q1, and direct current flowing to the secondary side of the transformer Tr1 is controlled so as to have a predetermined value. The direct current flowing through the secondary side of the transformer Tr1 is supplied to the LEDs 35 and lights the LEDs 35.

Here, the transistors Q2, Q3 and Q4 are PWM-controlled by the control circuit 117, and the LEDs 35 are lit while the transistors Q2, Q3 and Q4 are in an on-period and turned off while the transistors Q2, Q3 and Q4 are in an off-period. Since the LEDs 35 blink at a high speed although being repeatedly lit and turned off, it appears to a user that the LEDs 35 are continuously lit.

The transistors Q2, Q3 and Q4 are PWM-controlled and the LEDs 35 are subjected to light control based on a light control signal which is input into the control circuit 117 from the outside.

Since the lamp pins 44 for receiving power from the socket device 13 and the signal terminals 115 for receiving a signal transmitted from the socket device 13 are provided on the cap portion 38, output of the lighting circuit 37 is adjusted in accordance with the signal received by the signal terminals 115 and LEDs 35 can be subjected to light control.

Specifically, since the signal terminals 115 are connected to the signal brackets 113 in a state that the lamp pins 44 are brought into contact with the power supplying brackets 111, by attaching the lamp device 14 to the socket device 13, the LEDs 35 can be subjected to the light control.

When a lamp device having no light control function is connected to the socket device 13 for light control, no light control signal is transmitted from the socket device 13 side to the lamp device having no light control function, and the lamp device having no light control function is lit at a predetermined output regardless of a light control signal.

Since the signal terminals 115 are projected from the cap portion 38 of the lamp device 14 having the light control function, the lamp device 14 cannot be attached to a non-light control-type socket device.

Figure 28:
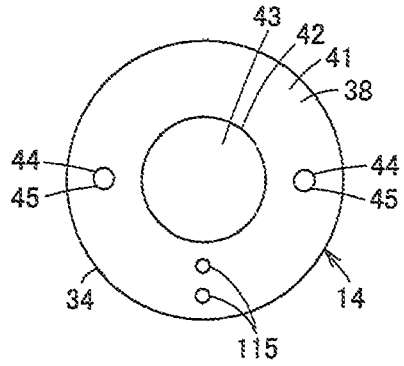
FIG. 28 is a plan view of a lamp device according to a fourteenth embodiment of the present invention.

Moreover, as shown in FIG. 28 showing a fourteenth embodiment, the pair of signal terminals 115 arranged on the cap portion 38 of the lamp device 14 may be arranged together orthogonally to the pair of lamp pins 44. In this case, an advantage can be obtained that the lamp pins 44 side having high voltage can be separated from the signal terminals 115 side to which a signal is transmitted and which have low voltage.

Figure 29:
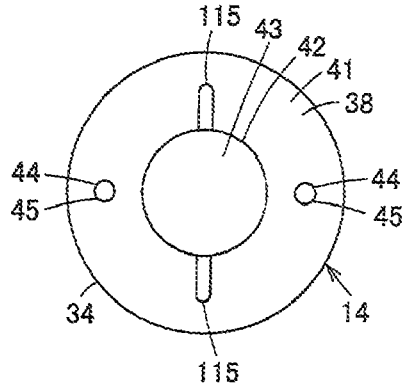
FIG. 29 is a plan view of a lamp device according to a fifteenth embodiment of the present invention.

As shown in FIG. 29 showing a fifteenth embodiment, the pair of signal terminals 115 arranged on the cap portion 38 of the lamp device 14 may be projected from a circumferential portion of the projection portion 42. In this case, structures corresponding to the connection hole 112 and the signal brackets 113 may be provided at the inside of the insertion hole 22 of the socket device 13.

Figure 30:
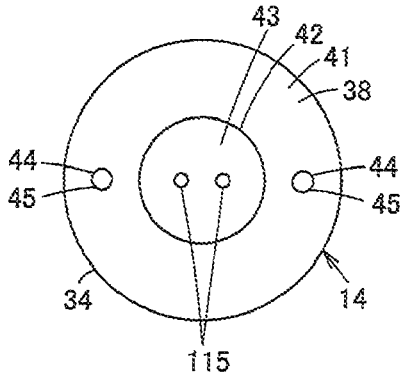
FIG. 30 is a plan view of a lamp device according to a sixteenth embodiment of the present invention.

As shown in FIG. 30 showing a sixteenth embodiment, the pair of signal terminals 115 arranged on the cap portion 38 of the lamp device 14 may be provided on the end face of the projection portion 42 of the cap portion 38. In this case, structures corresponding to the signal brackets 113 to be connected to the signal terminals 115 may be arranged at the fixture body 12 side.

Moreover, a signal transmitted to the lamp device 14 is not limited to a light control signal for subjecting the LEDs 35 to light control. An RGB signal for adjusting the color of the LED 35 is usable as the signal transmitted as long as the lamp device 14 enables color lighting.

Moreover, also in the fifth to sixteenth embodiments, similar to the first to fourth embodiments, the end face 43 of the projection portion 42 of the cap portion 38 and the heat radiating body can be pressed against each other in a contact direction by attaching the lamp device 14 to the socket device 13.

INDUSTRIAL APPLICABILITY

The present invention is applied to a downlight, a ceiling built-in type lighting fixture, a ceiling direct attachment-type lighting fixture, a suspending-type lighting fixture, a wall front face fixture and other lighting fixtures.

REFERENCE SIGNS LIST

11 Lighting fixture
12 Fixture body as heat radiating body
13 Socket device
14 Lamp device
21 Socket device body
22 Insertion hole
30 Elastic body as pressing body
34 Lamp device body
35 LED as light source, semiconductor light-emitting element
37 Lighting circuit
38 Cap portion
39 Substrate attachment portion
42 Projection portion
44 Lamp pin
50 Light-emitting module substrate
55 Heat radiating plate as heat radiating body
56 Spring as pressing body
60 Heat radiating plate as heat radiating body
61 Spring as pressing body
67 Heat radiating member as heat radiating body and pressing body
71 Socket support body
85 Screw as thermal conduction connection unit
94 Screw engaging portion as thermal conduction connection unit
111 Power supplying bracket as power supplying portion
113 Signal bracket as signal transmitting portion
115 Signal terminal
117 Control circuit

What is claimed is:

1. A lighting system comprising:

a socket device including a socket device body defining an insertion hole, the socket device body including a first wall and a second wall, wherein both the first and second walls are disposed around the insertion hole and wherein the first wall surrounds the second wall; and a lamp device configured to be attached to the socket device via insertion into the insertion hole, wherein the socket device body further comprises:

an elastic body being configured to press the lamp device, when attached to the socket device, in a direction of insertion through the insertion hole, wherein the elastic body is disposed exterior to the second wall and interior to the first wall in a direction orthogonal to the insertion direction; and a power supply portion disposed exterior to at least the second wall in the direction orthogonal to the insertion direction, wherein one of the socket device body and the lamp device includes a projection portion and another one of the socket device body and the lamp device includes a groove portion configured to receive the projection portion, and wherein the groove portion includes an introduction portion configured to receive initial insertion of the projection portion into the groove portion and an inclined portion configured to guide the projection portion to an engaged position with the groove portion.

2. The lighting system of claim 1, wherein the groove portion is provided on the socket device body and the projection portion is provided on the lamp device.

3. The lighting system of claim 1, wherein the groove portion is provided on the lamp device and the projection portion is provided on the socket device body.

4. The lighting system of claim 1, wherein the inclined portion is inclined in a direction in which the lamp device is configured to be inserted into the socket device body.

5. A lighting socket device comprising:

a first sidewall defining an insertion hole, the insertion hole configured to receive a lamp device therethrough;

a second sidewall surrounding the first sidewall; and a power supply portion disposed exterior to the the first sidewall and interior to the second sidewall in a direction orthogonal to a direction in which the lamp device is received in the insertion hole, wherein the socket device includes one of: a projection portion and a groove portion configured to receive the projection portion, and wherein the groove portion includes an introduction portion configured to receive initial insertion of the projection portion into the groove portion and an inclined portion configured to guide the projection portion to an engaged position with the groove portion.

6. The lighting socket device of claim 5, the socket device comprising the projection portion.

7. The lighting socket device of claim 5, the socket device comprising the groove portion.

8. The lighting socket device of claim 5, further comprising an elastic body exterior to the first sidewall in the direction orthogonal to the direction in which the lamp device is received in the insertion hole.

* * * * *